US005857859A

United States Patent [19]

Machill et al.

[11] Patent Number: 5,857,859

[45] Date of Patent: Jan. 12, 1999

[54] ELECTRICAL CONNECTOR HAVING AN ACTUATING SLIDE

[75] Inventors: Andreas Machill, Idstein; Horst Gehrke, Langen; Markus Kressmann, Frankfurt, all of Germany

[73] Assignee: The Whitaker Corporation, Wilmington, Del.

[21] Appl. No.: 694,051

[22] Filed: Aug. 8, 1996

[30] Foreign Application Priority Data

Aug. 22, 1995 [DE] Germany ..... 195 30 844.1

[51] Int. Cl.[6] ..... H01R 13/62

[52] U.S. Cl. ..... 439/157; 439/310

[58] Field of Search ..... 439/157, 147, 439/310, 341, 342

[56] References Cited

U.S. PATENT DOCUMENTS 5,244,400 9/1993 Hatagishi ..... 439/157
5,478,251 12/1995 Jaklin ..... 439/157

FOREIGN PATENT DOCUMENTS 0 587 174 A2 3/1994 European Pat. Off. .
0 625 809 A1 11/1994 European Pat. Off. .
92 05 859 U 9/1992 Germany .

*Primary Examiner*—Neil Abrams
*Assistant Examiner*—Brian J. Biggi
*Attorney, Agent, or Firm*—Driscoll A. Nina

[57] ABSTRACT

Electrical connectors having actuating slides, for connection to a second complementary connector, the actuating slide being attachable to an outer housing part of the first connector and the actuating slide interacting with the second connector, are known. The actuating slides often have a U-shaped design and are fastened to the outer housing part of the first connector. In order to ensure correct functioning of the actuating slide with the first connector, it is necessary for the actuating slide to be pushed onto the housing of the first connector from a specific direction. In order to achieve this, the outer housing part has guide means for guiding the actuating slide and the actuating slide has corresponding complementary means. The guide means and/or the actuating slide are/is configured in such a way that the actuating slide and the outer housing part can be joined together only from one side of the housing part. At its end, for example, the outer housing part has openings into which the flanks of the actuating slide can be pushed, the flanks of the actuating slide being configured with different cross sections at least at one point, such that the actuating slide can be introduced into the openings only from one side and only in a predetermined orientation.

3 Claims, 5 Drawing Sheets

ELECTRICAL CONNECTOR HAVING AN ACTUATING SLIDE

BACKGROUND OF THE INVENTION

1. Field of the Invention

The invention relates to an electrical connector having an actuating slide.

2. Description of the Prior Art

Electrical connectors having a multiplicity of electrical contacts are connected to complementary connectors and then form a connector pair. In this case, the higher the number of contacts to be connected, the greater is the force which is required to produce a connection between the connectors. It is known to use mechanical auxiliary means to connect the two connectors of the connector pair to one another. These mechanical auxiliary means may be designed either as an actuating slide or in the form of a lever. For connecting a connector with an actuating slide to a second complementary connector, it is possible to fit the actuating slide to an outer housing part of the first connector and the actuating slide interacting with the second connector in order to insert the pair of connectors one into the other.

Actuating slides are normally moved in a transverse direction with respect to the insertion direction of the connector. In this case, the actuating slide is integrated or fixed in one of the connectors and has either a guide slot or a guide groove or a pin, the connector to be connected then having the other part. If the two connectors are then joined together, the actuation of the actuating slide causes the lug to move through the slot. EP 587 174 A2 discloses an electrical connector arrangement, in particular for door connectors in automobiles. The connector arrangement has an insulating external housing and an actuating slide which has a U-shaped design. The connector housing is brought into the end position by actuating the actuating slide. The actuating slide in this case has at least one slot on each flank of the U. Pins which are arranged on the connector housing move in these slots.

Since the actuating slide and the external housing of the connector are produced in different work operations, it is necessary that they be joined together.

SUMMARY OF THE INVENTION

The invention is based on the object of specifying a connector having an actuating slide, the two of which can be joined together in a simple and reliable manner.

The object is achieved by means of an electrical connector comprising an actuating slide, for connection to a second complementary connector, the actuating slide being attachable to an outer housing part of the first connector and the actuating slide interacting with the second connector in order to insert the pair of connectors one into the other, a pin being moved through a guide groove or a guide slot during the actuation of the actuating slide for the purpose of connecting the connectors, and the pin being moved in the opposite direction through the guide groove or the guide slot during the actuation of the actuating slide for the purpose of separating the connectors, the actuating slide having a U-shaped design and at least one guide groove or one guide slot or one pin being formed in each flank of the U-shaped actuating slide, the outer housing part having guide means for guiding the actuating slide and the actuating slide having corresponding complementary means, wherein the guide means and/or the actuating slide are/is configured in such a way that it is possible to join together the actuating slide and the outer housing part only from one side of the housing part.

Advantageous developments are specified in the subclaims.

It is customary to produce connectors having actuating slides, the external housing of the connector and the actuating slide being produced in different work operations. The actuating slide is either inserted into the connector in openings in the external housing of the connector, the external housing then enclosing the actuating slide, or the actuating slide runs on guide rails which are provided on the outside of the external housing. For technical reasons of space and tools, it is often customary for the openings on the external housing to be accessible from both sides of the external housing. Closing off the openings by a wall on one side would result in the connector being enlarged by this wall thickness. Even when external rails are fitted, it is often possible to push the actuating slide onto the external housing of the connector from both sides. This is also the case when there are continuous openings on the external housing.

However, the functioning of the actuating slide is guaranteed only when the latter is brought into or onto the external housing of the connector from the correct side and in the correct orientation. The situation where the actuating slide and the external housing can actually only be joined together correctly is therefore expedient for facilitating the joining-together work operation.

This situation can be achieved by virtue of the fact that the guide means on the outer housing part and corresponding complementary means on the actuating slide are designed in such a way that the actuating slide and the outer housing part can be joined together only from one side of the housing part.

It is further advantageous, of course, if the guide means additionally ensure that the actuating slide can be inserted only in a predetermined orientation. If an actuating slide is inserted into the outer housing part through openings at the end of said outer housing part, then it is possible, for example, for the flanks of the actuating slide and the corresponding openings on the two sides of the outer housing part to be configured with different cross sections at least at one point. The effect that can be achieved thereby is that the actuating slide cannot be inserted into the openings with incorrect orientation. An additional effect that can be achieved is that the actuating slide cannot be pushed into the openings from the incorrect side.

If the actuating slide is inserted via a rail, it is possible, for example, to close this rail at one end. If a plurality of rails are provided, then it is sufficient if one rail is closed at one end.

Simple and reliable joining together of the connector and the actuating slide is also ensured by virtue of the fact that the friction between the connector and the actuating slide is minimized. This can be effected, on the one hand, in that use is made of appropriate materials which have a good sliding behaviour on one another, but it can also be achieved in that the bearing face for guidance between the outer housing part and the actuating slide is minimized. Of course, such minimization cannot be arbitrarily effected, since a robust guideway must furthermore be ensured.

If the guide rail is T-shaped, for example, then the comparatively large surface area on the crossbar of the T can have an inwardly cambered design or be stepped in such a way that the bearing face is considerably smaller than the area of the crossbar.

DETAILED DESCRIPTION OF THE PREFERRED EMBODIMENT

Figure 1:
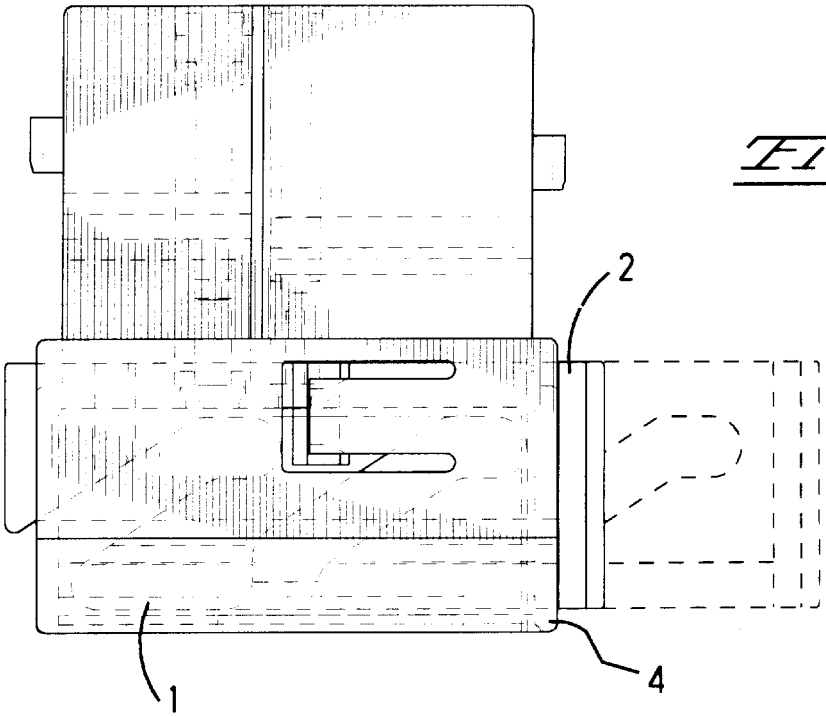
FIG. 1 shows an electrical connector having an actuating slide according to a first exemplary embodiment.

FIG. 1 shows an electrical connector 1, which has an actuating slide 2. The actuating slide 2 is illustrated in the pushed-in state. Its position in the outer housing part 4 is illustrated by dashed lines. The position of the actuating slide 2 in the pulled-out state is likewise illustrated by dashed lines.

Figure 2D:
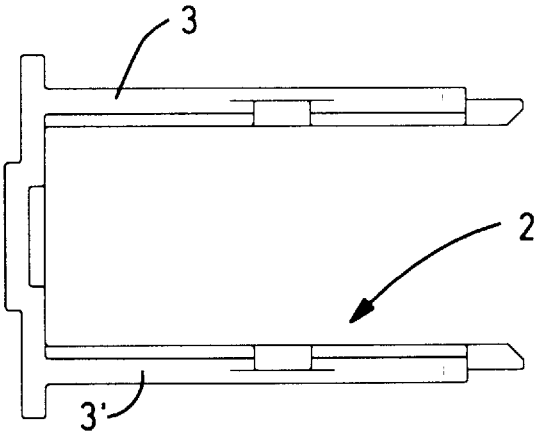
FIG. 2*a* shows a side view of the actuating slide according to FIG. 1.
FIG. 2*b* shows an upper plan view of the actuating slide.
FIG. 2*c* shows a cross section of the actuating slide as indicated in FIG. 2*a;*
Figure 2C:
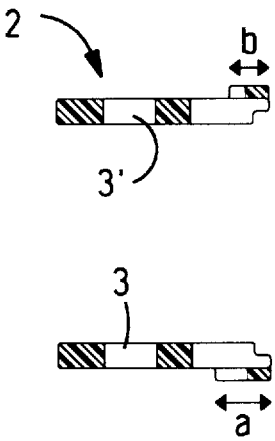
Figure 2A:
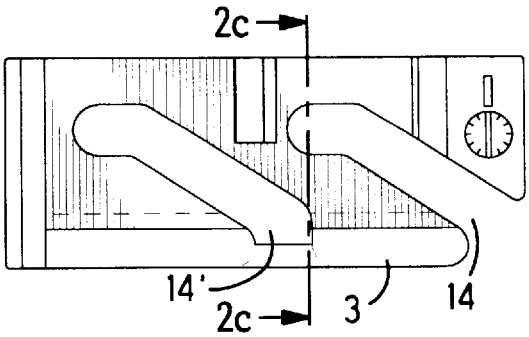
Figure 3A:
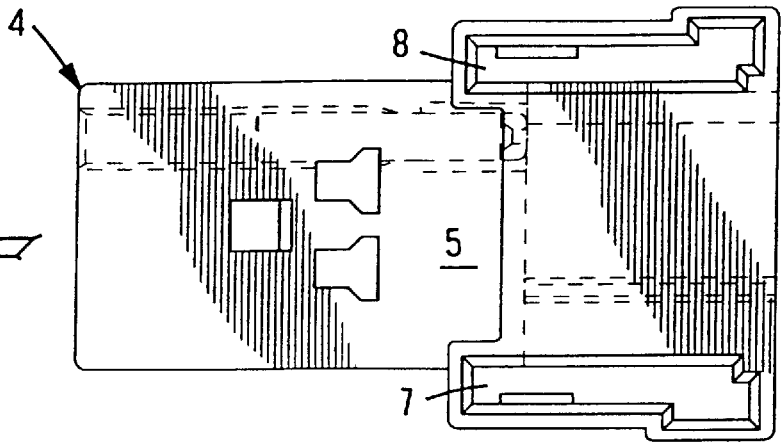
FIG. 3*a* shows an end view of the corresponding outer housing of FIG. 1.
Figure 3B:
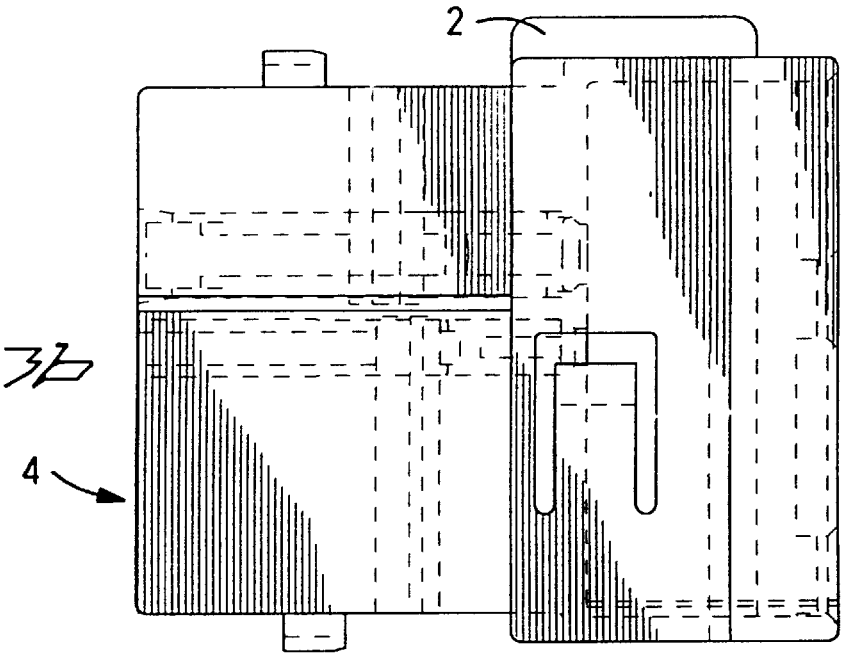
FIG. 3*b* shows a side view of the outer housing of FIG. 1.
Figure 3C:
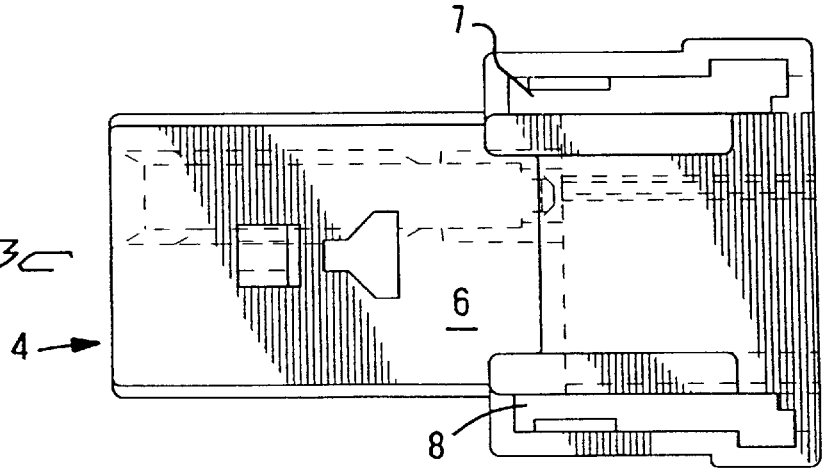
FIG. 3*c* shows a second end view of the outer housing of FIG. 1.

FIGS. 2*a*–2*c* show a more detailed illustration of the actuating slide. The actuating slide 2 has a U-shaped configuration. The U has two flanks 3 and 3'. Each flank has two guide slots 14, 14', in which the pins of the complementary connector are guided. As can be seen in FIG. 2*a,* the two flanks do not have identical cross sections, but differ from one another. The dimension of the widened portion a on the flank 3 is considerably larger than the dimension b on the flank 3'. A corresponding outer housing part 4 is illustrated in FIGS. 3*a*–3*c*. The outer housing part in each case has openings 7 and 8 at the ends 5 and 6. The actuating slide 2 can be pushed into the openings. The openings are in each case configured to correspond to the cross section of the flanks 3, 3' of the actuating slide 2. This special configuration prevents the actuating slide from being able to be inserted into the outer housing part from the incorrect side. The actuating slide is also prevented from being inserted into the housing part with incorrect orientation.

Figure 4:
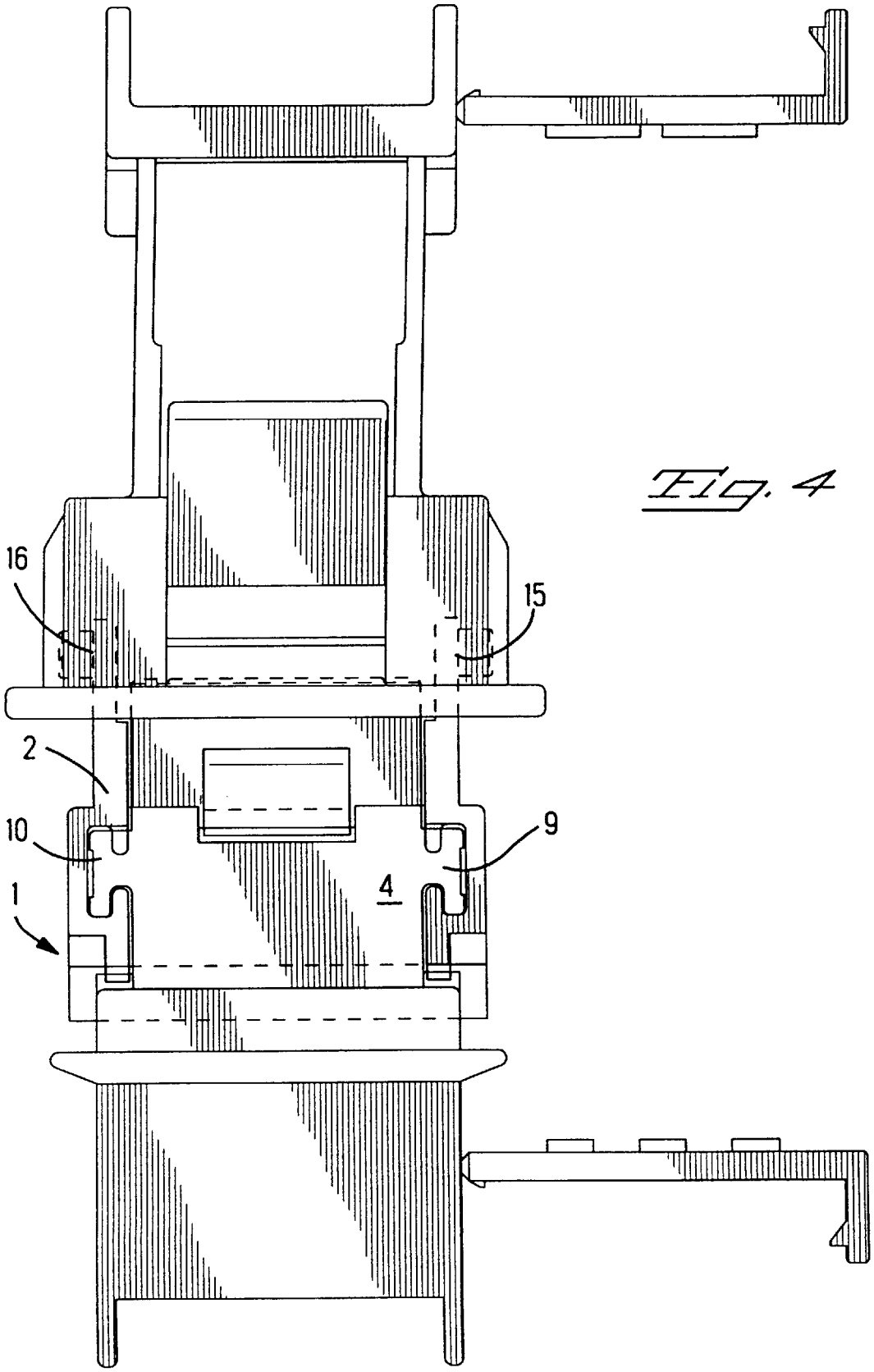
FIG. 4 shows an electrical connector having an actuating slide according to a second exemplary embodiment.

FIGS. 4–6 show a second exemplary embodiment of the invention. FIG. 4 illustrates a view of a connector 1 having an outer housing part 4 and an actuating slide 2. The actuating slide 2 has been pushed onto the outer housing part. The outer housing part 4 has a guide rail 9 for this purpose. The guide rail 9 has a T-shaped design. The actuating slide 2 has a corresponding T-shaped opening, which can be pushed onto the guide rail 9. In order to reduce the friction between the guide rail 9 and the actuating slide 2, the contact area between the two has been reduced. To this end, the surface of the crossbar of the T-shaped guide rail is not a planar area, rather it has a step. The guide rail does not make contact with the actuating slide underneath the step. This guarantees simplified fitting of the actuating slide, since the friction forces are reduced.

Figure 5C:
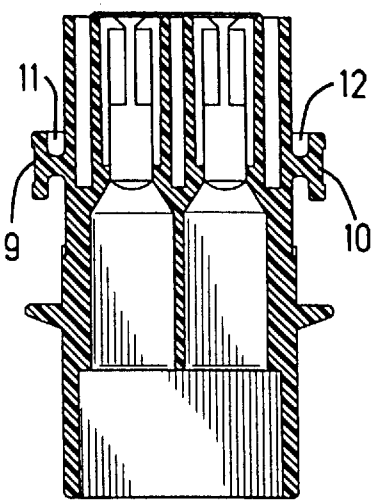
FIG. 5*c* shows a cross-sectional view of the outer housing of FIG. 5*a;*
Figure 5B:
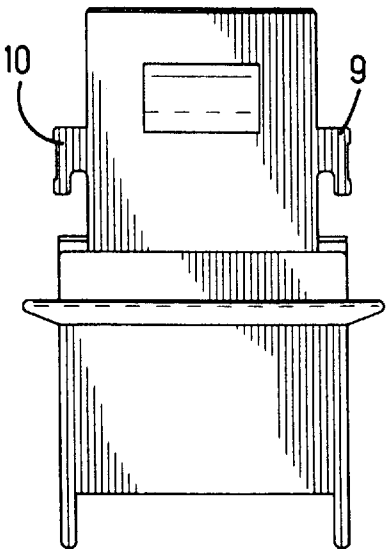
FIG. 5*b* shows an end view of the outer housing of FIG. 4.
Figure 5A:
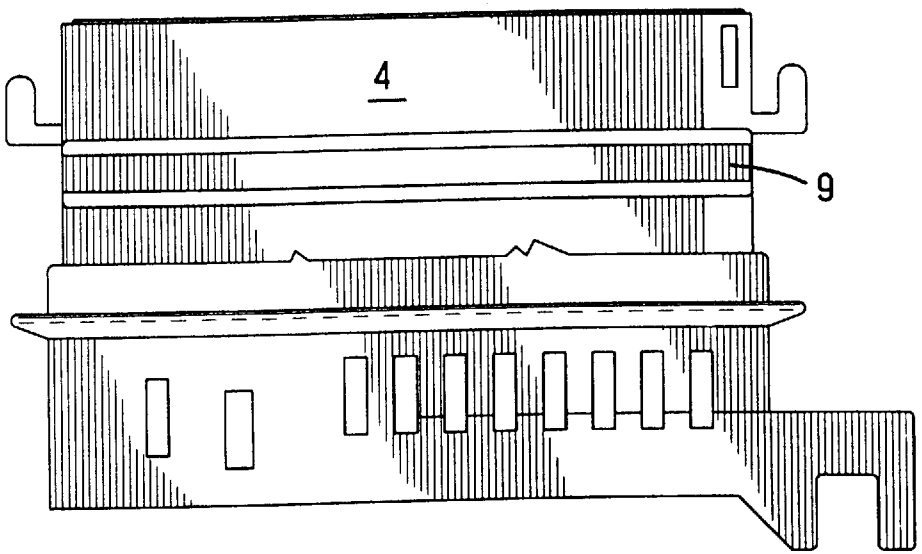
FIG. 5*a* shows a side view of the outer housing part of the second exemplary embodiment of FIG. 4.
Figure 6C:
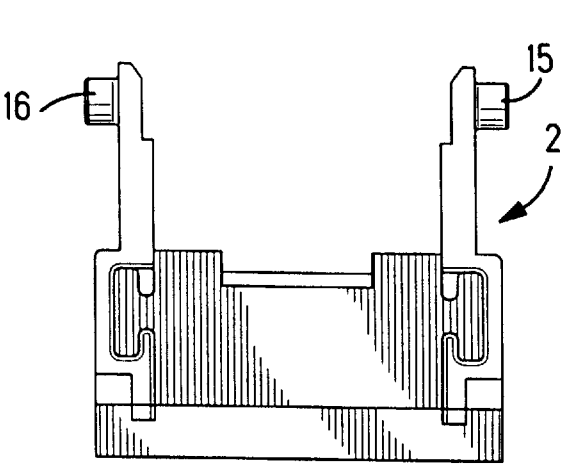
FIG. 6*c* shows an end view of the actuating slide of FIG. 6*a.*
Figure 6A:
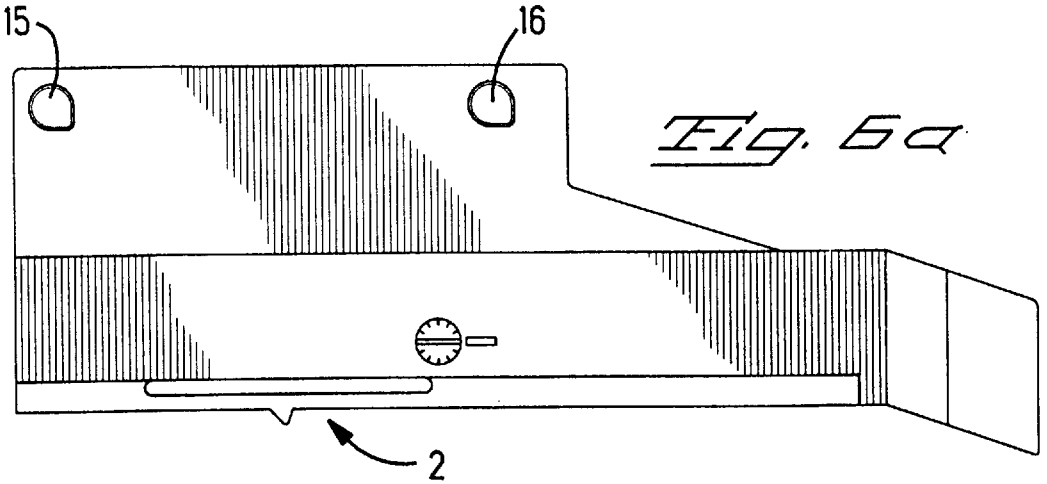
FIG. 6*a* shows the actuating slide of the second exemplary embodiment of FIG. 4 in side view.
Figure 6B:
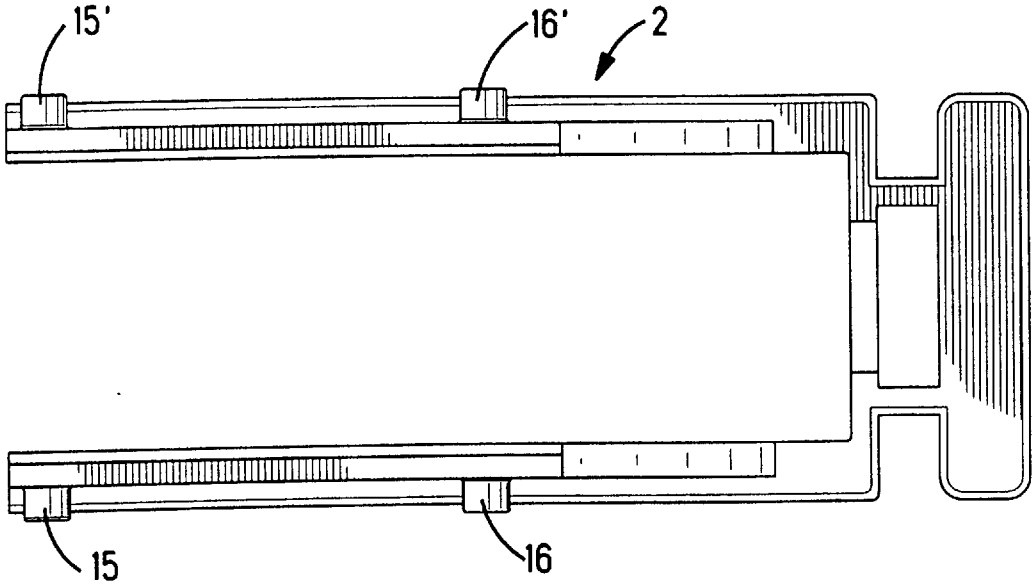
FIG. 6*b* shows a top view of the actuating slide of FIG. 6*a;*.

FIGS. 5*a*–5*c* illustrate the first connector in side view, in a view of the end face and in cross section. The guide rails 9, 10 can clearly be seen here. It can also be discerned that the guide rails are closed on one side. As a result, it is no longer possible to push the actuating slide in from this side. The two T-shaped guide rails 9 and 10 are in each case closed off only on one side of the web by a small wall 11, 12. It would also be sufficient if only one of the guide rails were closed off. This alone would have the consequence that the actuating slide can no longer be pushed onto the first connector from the incorrect side. FIGS. 6*a*–6*c* illustrate the design of the actuating slide. It is a U-shaped slide having respective pins 15, 16 on the flanks, which pins are used for guidance in the corresponding guide grooves or guide slots of a complementary connector. The pins 15, 16 are also illustrated by dashed lines in FIG. 4. The actuating slide 2 has, as illustrated in FIG. 6*c,* a T-shaped cutout, by which it can be pushed onto the guide rail of the outer housing part of the connector 1.

We claim:

1. A first electrical connector comprising an actuating slide, for connection to a second complementary connector, the actuating slide being attachable to an outer housing part of the first connector and the actuating slide interacting with the second connector in order to insert the pair of connectors one into the other, a pin being moved through a guide slot during the actuation of the actuating slide for the purpose of connecting the connectors, and the pin being moved in the opposite direction through the guide slot during the actuation of the actuating slide for the purpose of separating the connectors, the actuating slide having a U-shaped design and at least one guide slot being formed in each flank of the U-shaped actuating slide, the outer housing part of the first connector having guide means for guiding the actuating slide and the actuating slide having corresponding complementary means, the outer housing part having openings on both ends, rear openings and front openings, and wherein the two flanks of the actuating slide and the corresponding openings are configured to have different cross sections, such that the actuating slide can be inserted only into the front openings in a predetermined orientation and the actuating slide is able to extend through the rear openings.

2. The electrical connector as claimed in claim 1, wherein the guide means and the complementary means are configured in such a way that the bearing face for guidance between the outer housing part and the actuating slide is minimized maintaining a robust guideway.

3. A first electrical connector comprising an actuating slide, for connection to a second complementary connector, the actuating slide being attachable to an outer housing part of the first connector and the actuating slide interacting with the second connector in order to insert the pair of connectors one into the other, a pin being moved through a guide slot during the actuation of the actuating slide for the purpose of connecting the connectors, and the pin being moved in the opposite direction through the guide slot during the actuation of the actuating slide for the purpose of separating the connectors, the actuating slide having a U-shaped design and at least one pin being formed in each flank of the U-shaped actuating slide, the outer housing part having guide means for guiding the actuating slide and the actuating slide having corresponding complementary means, the outer housing part having openings on both ends, rear openings and front openings, and wherein the two flanks of the actuating slide and the corresponding openings are configured to have different cross sections, such that the actuating slide can be inserted only into the front openings in a predetermined orientation and the actuating slide is able to extend through the rear openings.

* * * * *